US005447277A

United States Patent [19]

Schlüter et al.

[11] Patent Number: 5,447,277

[45] Date of Patent: Sep. 5, 1995

[54] METHOD OF WINDING YARN ON A BOBBIN OR THE LIKE IN A STEPWISE HIGH PRECISION WINDING PROCESS

[75] Inventors: Ekkehard Schlüter, Neumünster; Heiner Kudrus, Barmstadt, both of Germany

[73] Assignee: Neumag-Neumuensterische Maschinen und Anlagenbau GmbH, Neumuenster, Germany

[21] Appl. No.: 87,181

[22] Filed: Jul. 2, 1993

[30] Foreign Application Priority Data

Jul. 17, 1992 [DE] Germany ..... 42 23 271.6

[51] Int. Cl.[6] ..... B65H 54/38; B65H 54/28

[52] U.S. Cl. ..... 242/18.1; 242/43 R

[58] Field of Search ..... 242/18.1, 18 DD, 43 R

[56] References Cited

U.S. PATENT DOCUMENTS

| | | | |
|---|---|---|---|
| 4,504,021 | 3/1985 | Schippers et al. | 242/18.1 |
| 4,504,024 | 3/1985 | Gerhartz | 242/18.1 |
| 4,667,889 | 5/1987 | Gerhartz | 242/18.1 |
| 4,697,753 | 10/1987 | Schippers et al. | 242/18.1 |
| 4,771,961 | 9/1988 | Sugioka | 242/18.1 |
| 4,779,813 | 10/1988 | Sugioka et al. | 242/18.1 |
| 5,056,724 | 10/1991 | Prodi et al. | 242/18.1 |

FOREIGN PATENT DOCUMENTS

| | | |
|---|---|---|
| 0093258 | 9/1983 | European Pat. Off. . |
| 0401781 | 12/1990 | European Pat. Off. . |
| 0486896 | 5/1992 | European Pat. Off. . |
| 3521120 | 2/1987 | Germany . |
| 4037278 | 5/1992 | Germany . |

*Primary Examiner*—Daniel P. Stodola
*Assistant Examiner*—Michael R. Mansen
*Attorney, Agent, or Firm*—Michael J. Striker

[57] ABSTRACT

The stepwise high precision winding method includes winding the yarn on the bobbin with a reciprocating yarn changing guide in a series of steps so that an outer circumferential speed of the yarn-bobbin package is constant; reducing the yarn guide reciprocation frequency in each step from a starting frequency value to a final frequency value while keeping a winding number constant during each step so that the final frequency value is proportional to a bobbin rotation frequency in each step, and then increasing the yarn guide reciprocation frequency discontinuously to another starting frequency value and beginning a following step with the yarn guide reciprocation frequency equal to the other starting frequency value; setting the starting frequency value in each step to not more than a fixed maximum frequency; setting the final frequency value in each step to not less than a certain fixed minimum frequency; and setting the winding number in the Sth step equal to either $i_S - i_S x/(M_S + x)$ or $i_S + i_S x/(M_S - x)$, wherein $x = a/2H$; $i_S$ is a mirror value for the Sth step, $M_S$ is the order of the mirror value for the Sth step, a = the lay spacing between windings of a Kth lay and a $(K+M_S)$th lay and H is a total height of the yarn-bobbin package.

9 Claims, 4 Drawing Sheets

METHOD OF WINDING YARN ON A BOBBIN OR THE LIKE IN A STEPWISE HIGH PRECISION WINDING PROCESS

BACKGROUND OF THE INVENTION

The present invention relates to a method of continuously winding yarn on a bobbin or the like.

In continuously winding yarn on bobbins, which are driven with the same circumferential speed, one distinguishes three different methods: scrambled winding, precision winding and stepwise precision winding.

In scrambled or pie winding the yarn guide reciprocation frequency is constant. Hence a constant yarn deposit angle results. Since however the rotation speed decreases with increasing bobbin diameter, the winding number i, i.e. the ratio of rotation speed to changing frequency, decreases with increasing diameter. When the winding number is a whole number or takes a value which differs from a whole number by a simple fraction, e.g. $1\frac{1}{2}$ (2 order), $2\frac{2}{3}$ (3. order), $5\frac{3}{4}$ (4 order), the so-called "mirror winding" results. For the sake of brevity in the following the numbers, for which mirror winding arises, i.e. the whole and fractional numbers, are designated as "mirror values".

The characteristic feature of a mirror winding is that the mirror winding is exactly laid on an already previously laid winding.

With integral winding numbers, i.e. with mirror values of the first order, the windings are put down in lays following each other. It is generally true that with a mirror value of the Mth order the winding of the K+M th lay is deposited exactly on the winding of the Kth lay.

A "lay" is defined as the yarn piece, which is laid on the bobbin during a twin stroke, i.e. while the yarn changing guide moves from one end of the bobbin to the other and back. A "winding" is defined as the yarn piece, which is laid during a revolution. The winding number i is the number of windings per lay.

Mirror windings can cause a series of difficulties, particularly unstable bobbin structures, difficulties in take-off on the concerned bobbin and nonuniformities in a subsequent dyeing process.

In high precision winding the yarn guide reciprocation frequency keeps a fixed relationship to the rotation speed of the bobbin; the winding speed also remains constant. Accordingly the bobbin rotation speed, and also the yarn guide reciprocation frequency, is always smaller with increasing bobbin diameter. The consequence of this is that the yarn deposit angle is always smaller. It is approximately proportional to the yarn guide reciprocation frequency. The consistency of the yarn wound on the bobbin deteriorates with smaller deposit angle. This method has only limited usefulness. It does however have the advantage that one can avoid mirror structure by proper selection of the winding number.

In stepwise high precision winding the wind up occurs in several steps. In each individual step the yarn guide reciprocation frequency f decreases in proportion to the bobbin rotation speed n. The winding number i=remains constant in each step. It is selected in a known method so that at the beginning of each step the maximum allowed yarn guide reciprocation frequency is used, i.e. the maximum deposit angle, which is approximately proportional to the winding number for a given diameter, is used in the method. The transition to the next step occurs in the known method normally when the deposit angle has reached the smallest allowed value. On transition to the new step the changing frequency is increased discontinuously so that the maximum yarn guide reciprocation frequency and the maximum deposit angle again adjust themselves as above. Accordingly the winding number jumps to a new smaller value. Thus the winding number can decrease by chance to a mirror value or into its critical range.

According to the Published German Patent Application 40 37 278, on which the invention is based, a computer determines from step to step the winding number and compares it with the approximate mirror value. When the calculated winding number does not fall in the critical region of the mirror value, it is used in operation. When it is in the critical range of the mirror value, a slightly larger winding number is used. This winding number is within a certain definite short distance from the mirror value, which depends particularly on the size and order number of the mirror value. Because of that, the winding of the (K+M)th lay is not deposited exactly on the winding of the Kth lay, but is displaced a predetermined lay spacing a from the winding of the Kth lay. The lay spacing a is determined from yarn center to yarn center and is thus necessarily larger than the width of the deposited yarn. It is recommended to make it as small as possible, if possible not larger than twice the width of the yarn.

According to the above-mentioned reference one tries to keep the number of the correct engagement as small as possible. Thus in that step the winding proceeds only with the correct winding number, in which a mirror winding is avoided. In the other steps one uses winding numbers, which result when one selects the maximum allowed changing frequency as the starting frequency. With this winding number the spacing of the windings of the corresponding lays are determined by chance and thus are nonuniform.

SUMMARY OF THE INVENTION

It is an object of the present invention to provide an improved method of winding yarn on a bobbin or the like in a stepwise high precision winding process so that the bobbin has a uniformly high packing density with reduced edge elevations.

According to the invention, the method of continuously winding yarn on a rotating bobbin in a stepwise high precision winding method, includes the steps of:

a) guiding the yarn onto the bobbin with a reciprocating yarn changing guide having a yarn guide reciprocation frequency;

b) winding the yarn on the bobbin with the reciprocating yarn changing guide in a series of successive steps so that an outer circumferential speed of the yarn-bobbin package is constant;

c) reducing the yarn guide reciprocation frequency in each step from a starting frequency value to a final frequency value while keeping a winding number constant during each step so that the final frequency value is proportional to a bobbin rotation frequency in each step, and then, after completing each step except the last, increasing the yarn guide reciprocation frequency discontinuously to another starting frequency value and beginning a following step with the yarn guide reciprocation frequency equal to the other starting frequency value;

d) setting the starting frequency value of the yarn guide reciprocation frequency in each step to not more than a fixed maximum frequency;

e) setting the final frequency value of the yarn guide reciprocation frequency in each step to not less than a certain fixed minimum frequency; and f) setting the winding number in the Sth step equal to either $i_S - i_S x/(M_S + x)$ or $i_S + i_S x/(M_S - x)$, wherein $x = a/2H$; $i_S$ is a mirror value of the Sth step, $M_S$ is the order of the mirror value for the Sth step, a = the lay spacing between windings of a Kth lay and a $(K+M_S)$th lay and H is a total height of the yarn-bobbin package.

According to the invention the winding number is in the vicinity of, but not equal to, the mirror value and differs from a mirror value $i_s$ by a definite amount or difference value. Each mirror value corresponds to one of two "winding numbers in the vicinity of the mirror value", of which one is smaller and the other larger than the mirror value. In the first case the amount of the difference is $$\Delta s_S = -i_s x/(M_s + x) \quad (1)$$

in the second case $$\Delta i_s = +i_s x/(M_s - x) \quad (2)$$

wherein $M_s$ is the order of the mirror value, $x = a/2H$,

H is the changing distance, i.e. the height or length of the yarn-bobbin package consisting of the bobbin and the yarn wound on it, a = the lay spacing between the windings of the Kth lay and the (K+M)th lay, measured from yarn strand to yarn strand; it is at least equal to the width and at most equal to 3 times, advantageously twice, the width of the yarn being deposited.

Since in practice normally the size x is negligibly small in comparison to the order, $M_s$, the size of both differences agrees closely with each other. It is characteristic that they are proportional to the winding number and are essentially inversely proportional to the order. They are also different in size from step to step.

The variables or parameters provided with the index s are different for different individual steps. In contrast the parameters a and H and thus the derived variable X are the same for all steps.

The critical feature of the above method can be stated in another way: namely that in each individual step the winding of the (K+M)th lay is deposited exactly a fixed distance a next to the winding of the Kth lay.

The discontinuous yarn guide reciprocation frequency increase can be made either when the minimum frequency is reached, when the diameter of the bobbin has grown by a predetermined increment or when the rotation speed of the bobbin has dropped far enough that the maximum changing frequency for the following step is reached.

Advantageously only first order mirror values are used in the method, but also second order mirror values can be used, especially in the subsequent winding steps.

BRIEF DESCRIPTION OF THE DRAWING

The objects, features and advantages of the present invention will now be illustrated in more detail by the following detailed description, reference being made to the accompanying drawing in which.

DESCRIPTION OF THE PREFERRED EMBODIMENTS

The choice of the "winding number in the vicinity of the mirror number but equal to it" or "mirror value adjacent winding number" for the individual steps of the method occurs with the help of an i-D graph, in which the hyperbolic boundary curves for minimum and maximum deposit angle and the beginning and final bobbin diameter are shown. In such diagrams the bobbin history or time evolution of the bobbin and yarn wound on it in stepwise high precision winding is generally shown by a stepped curve, which is between both boundary curves. It is characteristic of the method according to the invention that all steps parallel to the x-axis correspond to winding numbers in the vicinity of mirror numbers.

Figure 1:
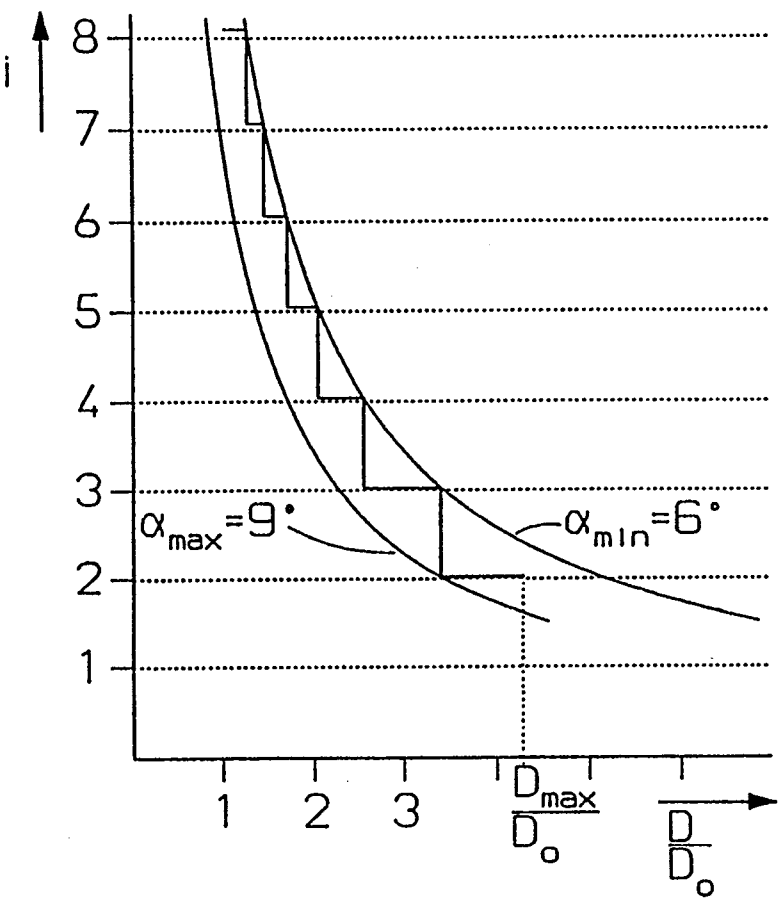

In the embodiment according to FIG. 1 the winding numbers are so selected that they have a definite positive spacing from the first order mirror values. The mirror values here are the integers from 8 to 2. Since it is known that the mirror values of higher order are arranged least densely on the number axis in the vicinity of the integral mirror values the limitation to winding numbers in the vicinity of the mirror values has the advantage that interference with mirror values of higher order is easily avoided. It is characteristic that the transition to the next step—i.e. the discontinuous increase of the yarn guide reciprocation frequency—always occurs exactly when the yarn guide reciprocation frequency and thus also the deposit angle has reached the lowest allowed value. As a result the upper corners of the stepwise curve all are on the hyperbolic curve, which is associated with the minimum deposit angle. The lower corners are between this hyperbolic curve and the hyperbolic curve which is associated with the maximum deposit angle.

In a typical example in practice

| | |
|---|---|
| the diameter of the bobbin itself | $D_o = 0.1$ m |
| the bobbin-yarn package height | H = 0.17 m |
| the width of the yarn | b = 1.7 mm |
| the lay spacing | a = 3.4 mm |
| the circumferential speed of the bobbin | v = 5.500 m/min |
| the minimum deposit angle | $\alpha min = 60°$ |
| the maximum deposit angle | $\alpha max = 9°$ |

As FIG. 1 shows the odiment of the winding process which begins with a winding number close to a mirror value, which is a little greater than 8. The exact value from the previous given equations (1) and (2) is:

$$i_1 = 8.08$$

The initial rotation speed of the bobbin is calculated as:

$$n_1 = 17.507 \text{ min}^{-1}$$

and the initial yarn guide reciprocation frequency is $$f_1=2.166\ \text{min}^{-1},$$

and the initial deposit angle is $$\alpha_1=7.63°.$$

The diameter attained at the end of the first step in the stepwise high precision winding process is $$D_1=0.127\ \text{m}.$$

On account of the increase in diameter the rotation speed of the bobbin at the end of the first step has decreased to $$n_2=13.739\ \text{min}^{-1},$$

the changing frequency at $$f_{min}=1.700\ \text{min}^{-1}*.$$

This is the minimum frequency, which corresponds to the minimum deposit angle 6°. The frequency is now increased discontinuously. From the rotation speed and the winding number close but not equal to the mirror number $i_2=7.07$ an initial changing frequency of $$f_2=1.943\ \text{min}^{-1}\ \text{results}.$$

The method is similar for the other steps in the stepwise high precision winding method of the invention. The corner of the stepwise curve or the edge of the step, which marks the start of the last step lies almost exactly although accidently on the hyperbolic boundary curve, which is associated with the maximum deposit angle 9°. In the last step a winding number close to the mirror value, $i_7$ of 2.02 is used, which varies from the associated mirror value 2 by only 0.02. The diameter at the end of the last step increases to $D_{max}=0.429$ m.

Figure 7:
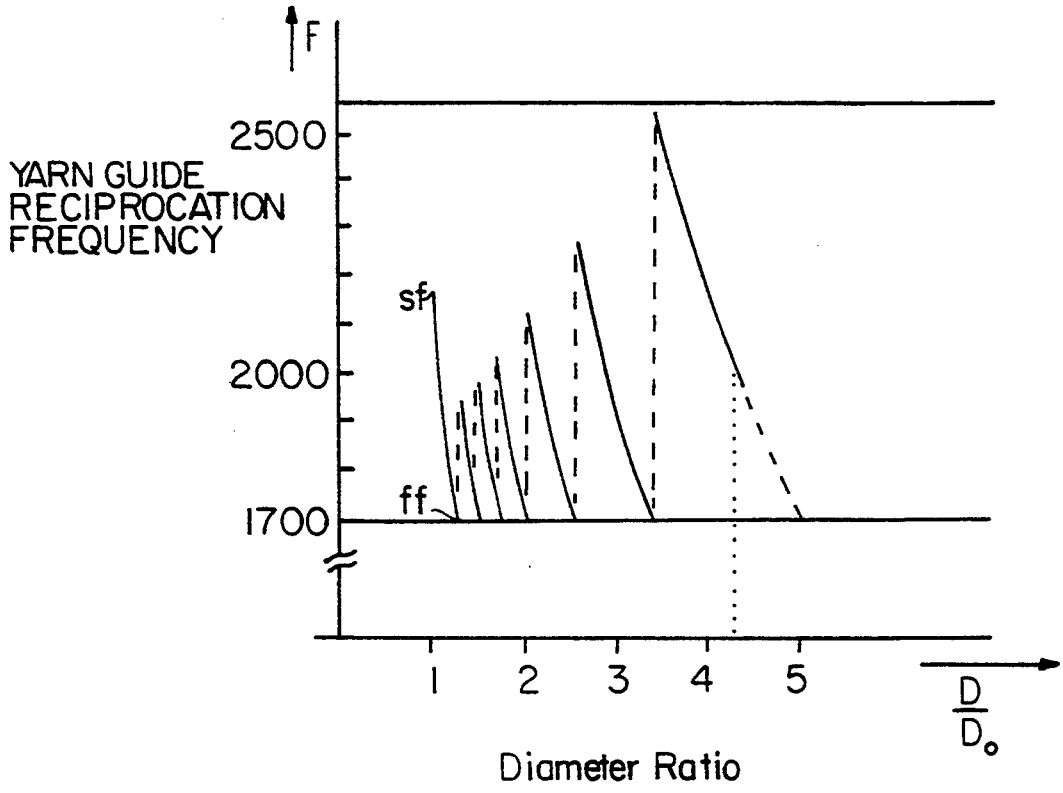
FIG. 7 is a graphical illustration of the relationship of yarn guide reciprocation frequency f to ratio for the embodiment of FIG. 1 in which the maximum deposition angle is 9° and the minimum deposition angle is 6°.

The dependence of the yarn guide reciprocation frequency, f, during the individual steps of the embodiment of FIG. 1 is shown in FIG. 7. The frequency decreases hyperbolically during each of the individual steps as expected because of the increase in diameter of the bobbin-yarn package as the yarn is wound on it. The starting frequency value, sf, for the first step and the final frequency value, ff, for the first step are also shown in FIG. 7.

Figure 2:
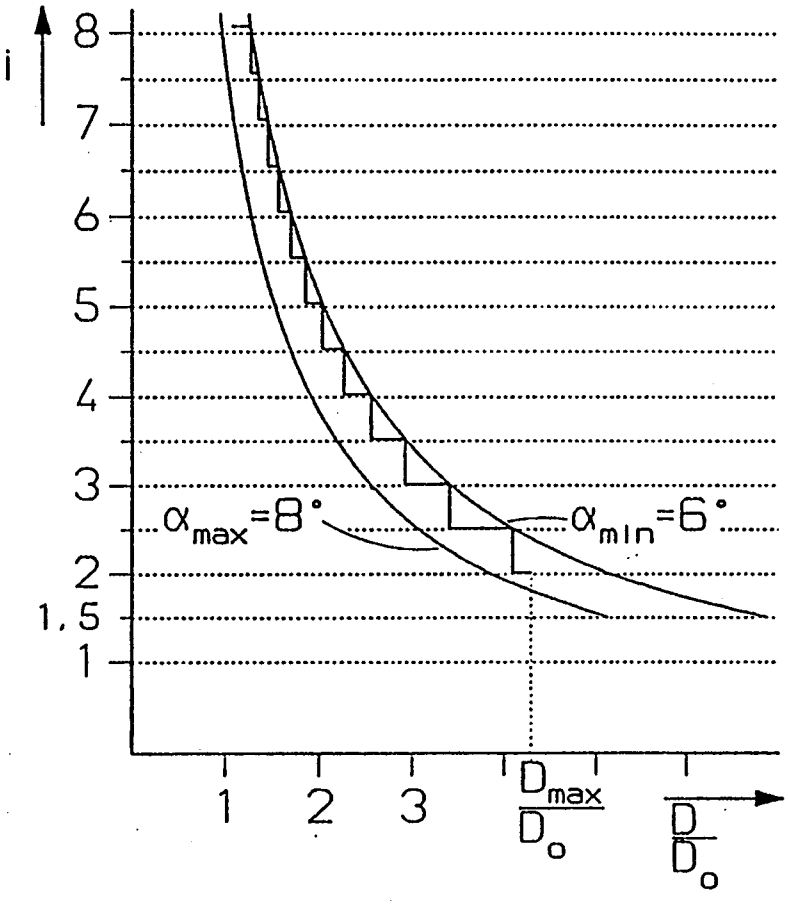
FIGS. 1 to 6 are graphical illustrations of the relationship of winding number to the diameter of the bobbin and yarn wound on it in several embodiments of the invention.

The embodiment of the method shown in FIG. 2 differs from the embodiment in FIG. 1, because the maximum deposit angle is only 8°. The maximum yarn guide reciprocation frequency is accordingly less than that of the first example. The stepped curve, which shows the history of the bobbin and yarn wound on it, must be accommodated in an intervening space between both hyperbolic boundary curves of reduced size in comparison to that between the corresponding curves in FIG. 1. This is possible since winding numbers close to the second order mirror values are used, i.e. to half integer values. These can be briefly designated as "mirror adjacent winding numbers, second order". The spacings of the associated mirror values are all nearly equal, namely 0.5. The spacing of the mirror adjacent winding numbers differs however slightly, since the difference between the mirror values and the associated mirror adjacent winding number depends additionally on the order number, which in this embodiment assumes the values 1 or 2 accordingly. The limitation to a reduced frequency range has the advantage that the frequency jumps occurring between the individual steps are reduced. Because of that the yarn-bobbin package consisting of the bobbin structure is improved.

Figure 3:
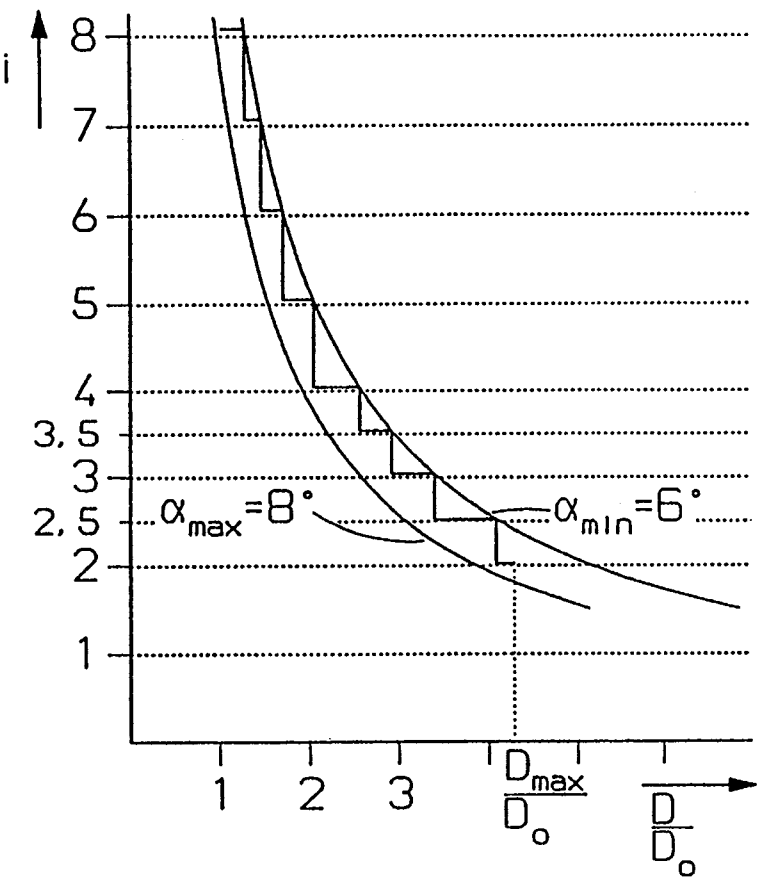

In the embodiment, which is illustrated in FIG. 3, the limiting angles similarly are 6° and 8°. At the beginning of the time evolution of the yarn-bobbin package consisting of the bobbin with the yarn being wound on it the method proceeds with winding numbers close to integral mirror values 8, 7, 6, 5, 4, i.e. with mirror adjacent winding numbers of first order. However if one were to jump directly from the winding number 4.04 to the next mirror adjacent winding number of first order in a manner similar to the method in FIG. 1, the starting deposit angle would exceed the highest limit in the corresponding step. In the final steps of the time history of the bobbin both first order and second order winding numbers are used. In comparison to the method of FIG. 2, the total number of the steps required in the method of FIG. 3 is reduced. The layers corresponding to the steps are correspondingly closer together in the vicinity of the bobbin.

Figure 4:
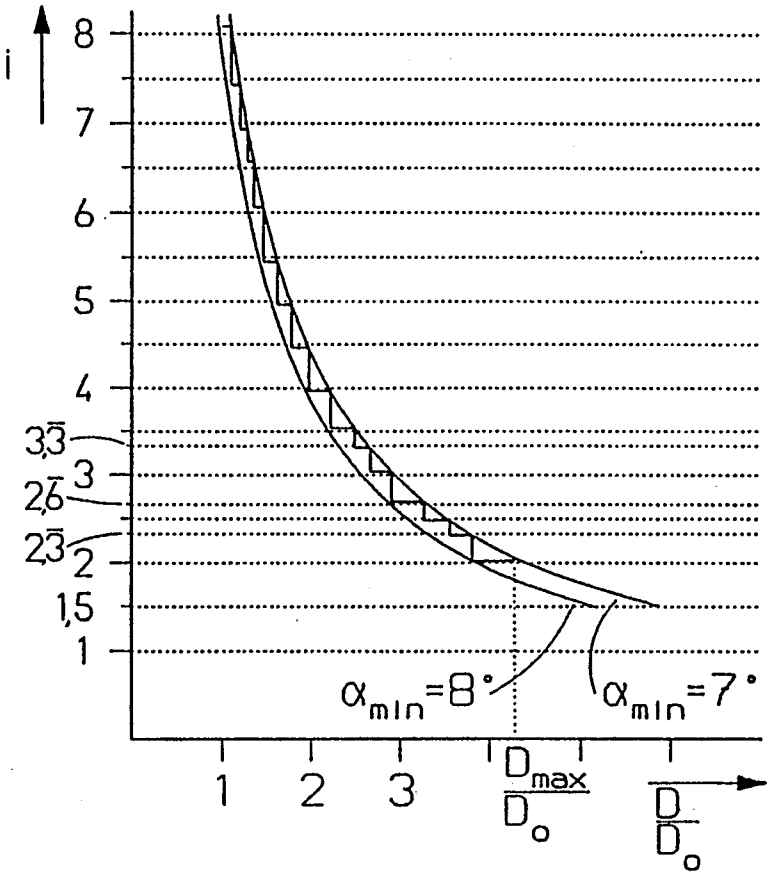

FIG. 4 illustrates an embodiment of the method, in which the deposit angle is limited to the extremely narrow range between 7° and 8°. Because of that the choices for the mirror adjacent winding number for the individual steps are strictly limited. In the first half of the time history of the bobbin mirror adjacent winding numbers of the first and second order are used. Deviating from the embodiments discussed up to now however mirror adjacent winding numbers are used which are smaller than the corresponding mirror values and of course the mirror values 7.5; 7; 5.5; 5; 4.5 and 4. Because of that the fitting of the stepwise curve of this embodiment of the stepwise high precision winding method in the narrow intervening space between the boundary curves is made easy. In the second half of the stepwise curve the method is further refined by use of mirror adjacent winding numbers of third order, whereby the spacing of the mirror adjacent winding number from the associated mirror values are partially positive, partially negative in irregular sequence.

Figure 5:
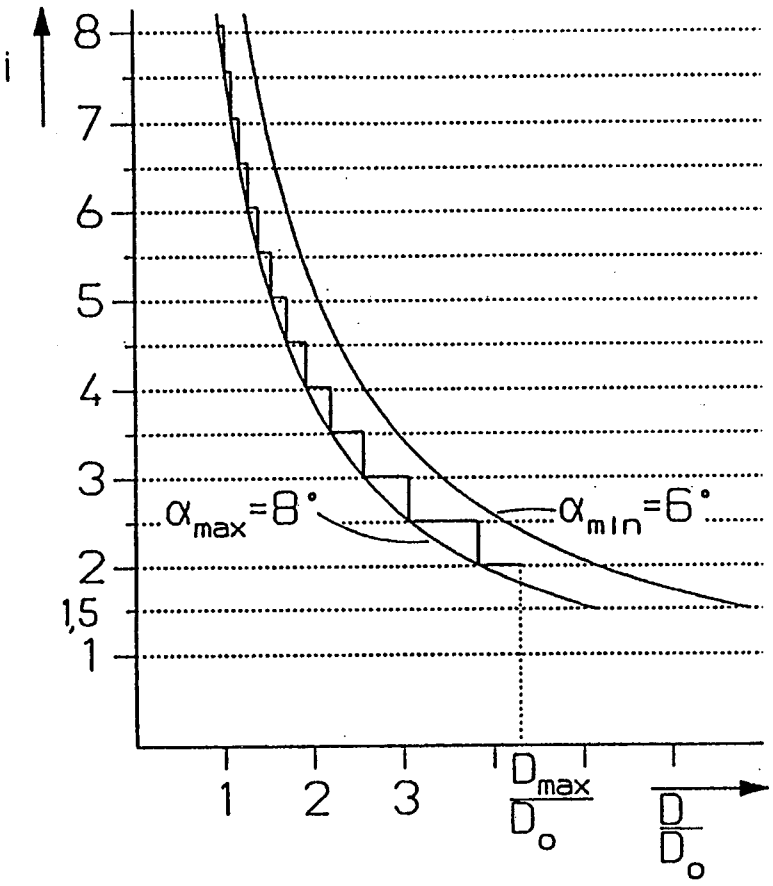

The example shown in FIG. 5 is a variation of the embodiment shown in FIG. 2. The difference is that the lower corners of the stepwise curve characteristic of this embodiment lies on the hyperbolic curve which corresponds to the maximum deposit angle. That means that after each step the frequency increase is performed at the moment, in which the bobbin rotation speed drops directly to such an extent that the maximum frequency is the starting frequency for the subsequent step.

Figure 6:
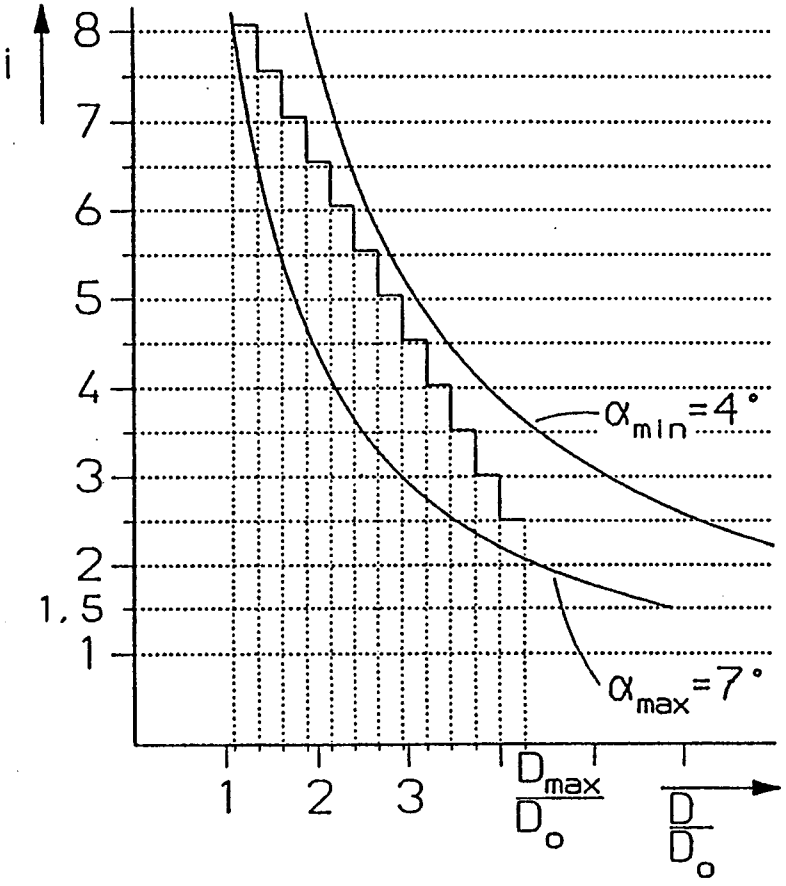

The embodiment of the method illustrated in FIG. 6 differs from all previously discussed embodiments, because the transition to the following step always occurs when the diameter has grown by the same predetermined increment for all steps. Mirror adjacent winding numbers of the first and second order are used in a gapless sequence starting from 8.08 and ending with 2.513. One knows that at the beginning and end of the time history of the bobbin and yarn wound on it the deposit angle has reached the maximum deposit angle. In the middle stage the deposit angle approaches the lower limiting value. Because of the uniform thickness of the layers wound in the individual steps the offset regions or shoulders occurring on the front of the bobbin are spaced uniformly. That has advantages when yarn is removed from the bobbin. When a comparatively large intervening space arises between the minimum and the maximum deposit angle, fine steps are required in the method.

While the invention has been illustrated and embodied in a method of winding yarn on a bobbin or the like in a stepwise high precision winding process, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

We claim:

1. Method of continuously winding yarn on a rotating bobbin in a stepwise high precision winding method, comprising:

a) guiding said yarn onto said bobbin with a reciprocating yarn changing guide, said yarn changing guide having a yarn guide reciprocation frequency;

b) winding said yarn on said bobbin in a series of steps so that a circumferential speed of a yarn-bobbin package consisting of said bobbin and said yarn wound on said bobbin is constant;

c) reducing said yarn guide reciprocation frequency in each of said steps from a starting frequency value to a final frequency value while keeping a winding number constant during each of said steps so that said final frequency value is proportional to a bobbin rotation frequency in each of said steps, and then, after completing each of said steps except a last one of said steps, increasing said yarn guide reciprocation frequency discontinuously to another starting frequency value and beginning a following one of said steps with said yarn guide reciprocation frequency equal to said other starting frequency value;.

d) setting said starting frequency value of said yarn guide reciprocation frequency in each of said steps to not more than a fixed maximum frequency;

c) setting said final frequency value of said yarn guide reciprocation frequency in each of said steps to not less than a certain fixed minimum frequency; and d) setting said winding number in each of said steps equal to one of $i_S - i_S x/(M_S + x)$ and $i_S + i_S x/(M_S - x)$, wherein S is a positive integer designating the step; $x = a/2H$; $i_S$ is a mirror value of the Sth step; $M_S$ is an order of said mirror value; a=a lay spacing between windings of a Kth lay and a $(K + M_S)$th lay; H is a total height of said yarn-bobbin package; and said K is another positive integer designating the lay.

2. Method as defined in claim 1, further comprising setting said lay spacing at most equal to twice a width of said yarn deposited on said bobbin.

3. Method as defined in claim 1, wherein said discontinuous increasing of said yarn guide reciprocation frequency after each of said steps occurs when said yarn guide reciprocation frequency has reached said fixed minimum frequency.

4. Method as defined in claim 1, wherein said discontinuous increasing of said yarn guide reciprocation frequency after completing each of said steps occurs so that said other starting frequency value in said following step equals said fixed maximum frequency.

5. Method as defined in claim 1, wherein said discontinuous increasing of said yarn guide reciprocation frequency occurs when said bobbin with said yarn-bobbin package has grown by a predetermined increment.

6. Method as defined in claim 1, wherein said winding number in all of said steps is first order.

7. Method as defined in claim 1, wherein the winding number in each of said steps does not have a higher order than second order.

8. Method as defined in claim 1, wherein successive spacings between said mirror values associated with said winding numbers are equal for all of said steps.

9. Method as defined in claim 1, wherein the winding number of each of said steps has a progressively higher order in successive steps as said winding proceeds.

* * * * *